US012179121B2

(12) United States Patent
Garofalo

(10) Patent No.: US 12,179,121 B2
(45) Date of Patent: Dec. 31, 2024

(54) MODULAR ELECTRONIC DICE SYSTEM

(71) Applicant: XPLORED S.R.L., Genoa (IT)

(72) Inventor: Enrico Garofalo, Chiavari (IT)

(73) Assignee: XPLORED S.R.L., Rapallo (IT)

( * ) Notice: Subject to any disclaimer, the term of this patent is extended or adjusted under 35 U.S.C. 154(b) by 276 days.

(21) Appl. No.: 17/628,647

(22) PCT Filed: Jul. 27, 2020

(86) PCT No.: PCT/IT2020/050186

§ 371 (c)(1),
(2) Date: Jan. 20, 2022

(87) PCT Pub. No.: WO2021/019586

PCT Pub. Date: Feb. 4, 2021

(65) Prior Publication Data

US 2022/0274009 A1 Sep. 1, 2022

(30) Foreign Application Priority Data

Jul. 30, 2019 (IT) ..... 102019000013365

(51) Int. Cl.
*A63F 9/04* (2006.01)
*A63F 9/24* (2006.01)

(52) U.S. Cl.
CPC ..... *A63F 9/0468* (2013.01); *A63F 9/0415* (2013.01); *A63F 2009/2447* (2013.01); *A63F 2009/2489* (2013.01); *A63F 2009/2491* (2013.01)

(58) Field of Classification Search
None
See application file for complete search history.

(56) References Cited

U.S. PATENT DOCUMENTS 6,331,145 B1 12/2001 Sity et al.
8,678,925 B1 * 3/2014 Kahn ..... G07C 15/008 463/36

(Continued)

FOREIGN PATENT DOCUMENTS

EP 2522408 A1 11/2012
JP 2007275107 A 10/2007
WO 2000052672 A1 9/2000

OTHER PUBLICATIONS

International Search Report for International Application No. PCT/IT2020/050186 mailed Feb. 4, 2021.

(Continued)

*Primary Examiner* — Damon J Pierce
(74) *Attorney, Agent, or Firm* — PERKINS COIE LLP; Colin Fowler; Willa Wu

(57) ABSTRACT

The proposed invention relates to a system for electronic dice, i.e., those devices which are in practice used for board games and parlour games with the support of electronic components. The invention comprises a hardware structure for the tracking and remote transmission of the result of the roll of a die adaptable and usable for various types of dice and, if necessary, transferable between different dice casings heterogeneous in shape, functions and mode of use; said structure being programmable to automatically recognize (Continued)

T1

| Face Number | Vx | Vy | Vz | dV | DV | Result |
|---|---|---|---|---|---|---|
| 1 | X1.1 | Y1.1 | Z1.1 | d1.1 | DV | R1.1 |
| 2 | X2.1 | Y2.1 | Z2.1 | d2.1 | DV | R2.1 |
| 3 | X3.1 | Y3.1 | Z3.1 | d3.1 | DV | R3.1 |
| 4 | X4.1 | Y4.1 | Z4.1 | d4.1 | DV | R4.1 |

301

T2

| Face Number | Vx | Vy | Vz | dV | DV | Result |
|---|---|---|---|---|---|---|
| 1 | X1.2 | Y1.2 | Z1.2 | d1.2 | DV | 9 |
| 2 | X2.2 | Y2.2 | Z2.2 | d2.2 | DV | 10 |
| 3 | X3.2 | Y3.2 | Z3.2 | d3.2 | DV | J |
| 4 | X4.2 | Y4.2 | Z4.2 | d4.2 | DV | Q |
| 5 | X5.2 | Y5.2 | Z5.2 | d5.2 | DV | K |
| 6 | X6.2 | Y6.2 | Z6.2 | d6.2 | DV | A |

302

[...]

Tq

| Face | Vx | Vy | Vz | dV | DV | Result |
|---|---|---|---|---|---|---|
| 1 | X1.q | Y1.q | Z1.q | d1.q | DV | R1.q |
| 2 | X2.q | Y2.q | Z2.q | d2.q | DV | R2.q |
| .. | .. | .. | .. | .. | .. | .. |
| m | Xm.q | Ym.q | Zm.q | dm.q | DV | Rm.q |
| .. | .. | .. | .. | .. | .. | .. |
| Nq | XN.q | YN.q | ZN.q | dN.q | DV | RN.q |

303

[...]

T4

| Face Number | Vx | Vy | Vz | dV | DV | Result |
|---|---|---|---|---|---|---|
| 1 | X1.4 | Y1.4 | Z1.4 | d1.4 | DV | 1 |
| 2 | X2.4 | Y2.4 | Z2.4 | d2.4 | DV | 2 |
| 3 | X3.4 | Y3.4 | Z3.4 | d3.4 | DV | 3 |
| 4 | X4.4 | Y4.4 | Z4.4 | d4.4 | DV | 4 |

[...]

TQ

| Face | Vx | Vy | Vz | dV | DV | Result |
|---|---|---|---|---|---|---|
| 1 | X1.Q | Y1.Q | Z1.Q | d1.Q | DV | R1.Q |
| 2 | X2.Q | Y2.Q | Z2.Q | d2.Q | DV | R2.Q |
| 3 | X3.Q | Y3.Q | Z3.Q | d3.Q | DV | R3.Q |
| .. | .. | .. | .. | .. | .. | .. |
| m | Xm.Q | Ym.Q | Zm.Q | dm.Q | DV | Rm.Q |
| .. | .. | .. | .. | .. | .. | .. |
| Nq | XN.Q | YN.Q | ZN.Q | dN.Q | DV | RN.Q |

300 and adapt to the different shape and type of dice in which it is applied and being conveniently applicable for simultaneous and multiple rolls and for further processing of the results. The solution referred to in the patent is realized through a core containing an electronic board structurally similar to that integrated in common commercial electronic dice and comprises an accelerometer, a Radio Frequency transmitter—preferably but not necessarily of the Bluetooth type—a CPU, a battery and a memory for information management and process control. The fact that the core hosting the electronic board can be inserted inside these dice in the form of polyhedral casings by means of a unique interlocking and, therefore, by means of a single possible orientation, allows to know a priori the relative orientation of the electronic board and, in particular, of the accelerometer with respect to the body of the dice or the host casing. Said relative orientation between the core and the possible host dice being predetermined and known, the invention is able to determine the result of the rolls simply knowing the type of die in which the core is housed (hence the number of faces in the case of regular polyhedra and the values which characterize said faces). For each type of dice (i.e., with the varying of the faces, the varying values represented on said faces and any rules of use), one or more tables or look-up-tables are provided, preloaded in the memory of the electronic board of the core so as to know the result of the relative orientation of the accelerometer gravity vector and therefore of the roll of the die upon the varying of the most varied types and areas of application.

12 Claims, 5 Drawing Sheets

(56) References Cited

U.S. PATENT DOCUMENTS

| | | | |
|---|---|---|---|
| 9,155,958 | B2 | 10/2015 | Zylkin |
| 10,527,685 | B2 | 1/2020 | Garofalo |
| 11,123,632 | B2 | 9/2021 | Garofalo |
| 2009/0104976 | A1 | 4/2009 | Ouwerkerk et al. |
| 2014/0309016 | A1 | 10/2014 | Hawkins et al. |
| 2015/0014923 | A1 | 1/2015 | Muse et al. |
| 2020/0222793 | A1 | 7/2020 | Garofalo |

OTHER PUBLICATIONS

Written Opinion for International Application No. PCT/IT2020/050186 mailed Feb. 4, 2021.

* cited by examiner

Fig.3

| T1 | | | | | | |
|---|---|---|---|---|---|---|
| **Face Number** | **Vx** | **Vy** | **Vz** | **dV** | **DV** | **Result** |
| **1** | X1.1 | Y1.1 | Z1.1 | d1.1 | DV | **R1.1** |
| **2** | X2.1 | Y2.1 | Z2.1 | d2.1 | DV | **R2.1** |
| **3** | X3.1 | Y3.1 | Z3.1 | d3.1 | DV | **R3.1** |
| **4** | X4.1 | Y4.1 | Z4.1 | d4.1 | DV | **R4.1** |

301

| T2 | | | | | | |
|---|---|---|---|---|---|---|
| **Face Number** | **Vx** | **Vy** | **Vz** | **dV** | **DV** | **Result** |
| **1** | X1.2 | Y1.2 | Z1.2 | d1.2 | DV | **9** |
| **2** | X2.2 | Y2.2 | Z2.2 | d2.2 | DV | **10** |
| **3** | X3.2 | Y3.2 | Z3.2 | d3.2 | DV | **J** |
| **4** | X4.2 | Y4.2 | Z4.2 | d4.2 | DV | **Q** |
| **5** | X5.2 | Y5.2 | Z5.2 | d5.2 | DV | **K** |
| **6** | X6.2 | Y6.2 | Z6.2 | d6.2 | DV | **A** |

302

[...]

| Tq | | | | | | |
|---|---|---|---|---|---|---|
| **Face** | **Vx** | **Vy** | **Vz** | **dV** | **DV** | **Result** |
| **1** | X1.q | Y1.q | Z1.q | d1.q | DV | **R1.q** |
| **2** | X2.q | Y2.q | Z2.q | d2.q | DV | **R2.q** |
| **..** | ... | ... | ... | ... | ... | **...** |
| **m** | Xm.q | Ym.q | Zm.q | dm.q | DV | **Rm.q** |
| **..** | ... | ... | ... | ... | ... | **...** |
| **Nq** | XN.q | YN.q | ZN.q | dN.q | DV | **RN.q** |

303

[...]

| T4 | | | | | | |
|---|---|---|---|---|---|---|
| **Fece Number** | **Vx** | **Vy** | **Vz** | **dV** | **DV** | **Result** |
| **1** | X1.4 | Y1.4 | Z1.4 | d1.4 | DV | **1** |
| **2** | X2.4 | Y2.4 | Z2.4 | d2.4 | DV | **2** |
| **3** | X3.4 | Y3.4 | Z3.4 | d3.4 | DV | **3** |
| **4** | X4.4 | Y4.4 | Z4.4 | d4.4 | DV | **4** |

[...]

| TQ | | | | | | |
|---|---|---|---|---|---|---|
| **Face** | **Vx** | **Vy** | **Vz** | **dV** | **DV** | **Result** |
| **1** | X1.Q | Y1.Q | Z1.Q | d1.Q | DV | **R1.Q** |
| **2** | X2.Q | Y2.Q | Z2.Q | d2.Q | DV | **R2.Q** |
| **3** | X3.Q | Y3.Q | Z3.Q | d3.Q | DV | **R3.Q** |
| **..** | ... | ... | ... | ... | ... | **...** |
| **m** | Xm.Q | Ym.Q | Zm.Q | dm.Q | DV | **Rm.Q** |
| **..** | ... | ... | ... | ... | ... | **...** |
| **Nq** | XN.Q | YN.Q | ZN.Q | dN.Q | DV | **RN.Q** |

300

MODULAR ELECTRONIC DICE SYSTEM

CROSS-REFERENCE TO RELATED APPLICATIONS

This application is a § 371 national phase application of PCT/IT2020/050186 filed Jul. 27, 2020 entitled "MODULAR ELECTRONIC DICE SYSTEM," which claims the benefit of and priority to Italian Patent Application No. 102019000013365 filed Jul. 30, 2019, the contents of which being incorporated by reference in their entireties herein.

TECHNICAL FIELD

The finding and object of the invention relates to the field of so-called electronic dice, i.e., to those devices which, in practice, are used for board games and parlour games characterized by the support of electronic components. More precisely, the invention relates to a device for the tracking and remote communication of the orientation of a die and the relative method of use, said invention being conveniently employable to transmit the result of the roll of a die to a remote electronic device such as, for example, a PC, a tablet, a smartphone or a game console. Said system allowing to track, using the same removable and transferable hardware component, a plurality of dice different from each other in type, shape, results and functions, i.e., being usable regardless of the generic number of faces of the die (N) and being usable regardless of the type of symbols shown on said faces. Said system can be further used to track simultaneous rolls of multiple dice, possibly heterogeneous, whose results/values must be further combined with each other.

BACKGROUND ART

Dice have been used in the world of games since Roman times, but their use has changed over time and today the use of these playful elements is very widespread in applications and games in which an element of chance is to be introduced. Precisely with this objective, in order to manage different statistical situations and probability, in addition the traditional cube-shaped dice, dice with a different number of faces have recently been created, generally consisting of regular polyhedra or at least isohedra, i.e., with all the same faces, which expand the possible cases of the results and allow to manage different probabilistic situations. A typical example of this is the dice of various shapes used in so-called role playing games or in some board games, said dice are characterized by shapes such as the tetrahedron (pyramid with 4 faces consisting of equilateral triangles), the cube (traditional shape with 6 square faces), the octahedron (polyhedron with 8 faces consisting of equilateral triangles), the dodecahedron (with 12 faces consisting of regular pentagons) and the icosahedron (with 20 faces consisting of equilateral triangles), to which is added, in some applications, the decahedron (a polyhedron with 10 faces consisting of polygons called kites).

These particular polyhedra, on whose faces can be depicted numbers or, sometimes, even symbols, can be used individually or in groups, both homogeneous and heterogeneous, depending on the case, the type of activity/game carried out, the type of event and probability of success for which the element of randomness is intended to be inserted; furthermore, depending on the situations, the result obtained by rolling the dice can provide complex combinations of the results obtained with each element: from the simple sum of all the results, to the weighted sum which involves discarding the highest or lowest results, to complex algorithms which provide averages, combinations of sums and subtractions, use of different dice for units, tens and hundreds, and so on.

Recently, with the increasing diffusion of electronic devices, some board games and parlour games which use physical dice for probability management have begun to accompany traditional paper manuals with dedicated applications and tools, which manage the rules of the game for players and provide support in assessing game progress; however, being software applications, these systems require users to manually enter the result obtained in the roll of the dice, after applying the rule provided for in the specific case, or in some cases, they can calculate the result using the data entered by the user.

To avoid the need for manual insertion of the result of the roll of a die, thus making the calculation of the result more fluid and automatic by the support applications, dice have recently been developed, known commercially as electronic dice, which present the features of a traditional die, but further integrate an automatic orientation detection system and a radio communication system, said systems are powered by appropriate internal batteries and are used to communicate the result of a roll of the die to other connected electronic devices such as a PC, smartphone, tablet, console and the like.

Going further into the constructive details, it is noted that most of the commercial solutions currently on the market employ a gyroscope and/or an accelerometer for orientation detection and remotely communicate data relating to these components through a radio system, typically low frequency or Bluetooth. This last transmission choice, although energetic, is made for obvious reasons of diffusion of said technology and, in particular, for the practicality of combining it with the aforementioned commercial electronic devices.

Also from a patent point of view, a number of proposals concerning electronic dice have been put forward. For example, a traditional cube-shaped die comprising a position detection system and a transmitter for transmitting the data of said position to a remote receiver is known from US Patent 2009/0104976 (Philips Intellectual Property & Standards). However, this system has considerable limits of precision and poor adaptation to any inaccuracies in the area of use so that it cannot be conveniently applied to dice other than the traditional six-sided cubic dice. In later times, therefore, the problem of creating electronic dice with N faces was addressed, for example in WO0052672 and U.S. Pat. No. 6,331,145 (Cibro Technologies Ltd). These solutions, which have managed to increase the number of trackable faces using predominantly passive RFID or optical technologies, present the difficulty of having to be used on dedicated surfaces (equipped, in fact, with RFID and optical sensors) and, in the case of RFID technology, present the additional difficulty of interference from multiple readings in the case of TAGs placed on opposite faces or, in the case of dice with typically even faces, characterized by two stable diametrically opposite equilibrium positions. Finally, both of the solutions mentioned suffer from possible difficulties in acquiring the result, if contact with the support surface is irregular, and are characterized by a certain complexity of incorporating the sensors into the dice casing, if the number of faces increases significantly.

With the advent and rapid diffusion of technologies related to mobile telephony and essentially the use of accelerometers and gyroscopes in mobile phones, solutions based on this type of hardware have been developed, such as in patents US2014/309016 A1 (Hawkins Scott Allan [US] et al) EP2522408 (Gik Sp. Z o.o. Sp. k). According to said solutions, electronics provided with at least one accelerometer, preferably with three axes, and a wireless communication module, preferably Bluetooth, are inserted inside a gaming dice, which allows tracking and transmitting the result of a die with N faces. The resolving scheme employed in these patents is that currently predominant in the field of commercial electronic dice and consists in providing a prefixed and symmetrical recess inside the die in which control electronics are placed and in carrying out the transmission to the external system of the gravity vector, said vector being detected following the roll of the die. According to said scheme, the remote device then interprets the data received from the electronic die, and in particular the gravity vector, verifying its orientation by means of a table which defines a priori the unique correspondence between the N faces of the die and the gravity vector received, according to the possible result combinations of the roll. Said solution is an improvement on the previous patents and allows to track the roll of dice with different types of geometries and number of faces, but at the same time it still presents open problems.

The system proposed in the aforementioned patents, in particular, allows to track dice with a number of faces greater than the classic six-sided cube, but, for each type of dice (for example with 8, 10, 12, 20 faces, etc.), requires specific calibrations for each geometry and, consequently, provides for the use of a dedicated electronic board for each type of die, that is, closely related to the shape and number of faces of the die used. In fact, according to this solution, as in most accelerometer-based commercial dice, it is necessary to "calibrate" the accelerometer used with respect to the casing of the dice itself and in particular to evaluate, a priori and for compensatory purposes, the deviation between the reference system [x, y, z] used by the accelerometer (which is typically integral with the electronic board in which it is inserted) and the reference system [xd, yd, zd] of the die in its real physical environment. This is in order to evaluate the positioning and relative orientation of the accelerometer used with respect to the casing of the specific die in which said electronic board will be used. Obviously, the measurement of this deviation between the native coordinates of the accelerometer and those of the physicality of the die changes considerably according to the number, orientation and arrangement of the die faces (for greater accuracy according to the orthogonal vector with respect to the die faces). For this reason, the current solutions must be adapted to the physicality of the die and the related electronics must be uniquely customized according to the physicality of the individual die, not being replicable in other contexts.

Lastly, the system referred to in the aforementioned patent is characterized, like the majority of the electronic dice currently on the market, for remotely transmitting all the data obtained from the inertial platform (accelerometer and/or gyroscope), delegating to the receiving system the interpretation of the data, which involves a high use of the radio communication protocol, resulting in energy expenditure which, from a constructive point of view, forces the use of bulky batteries.

DISCLOSURE OF THE INVENTION

To overcome the aforementioned limits and for obvious reasons of cost, uniformity and convenience of use with respect to the aforementioned solutions, the creation of a system is desired to track the result of the roll of a die which is easily adaptable to different types of dice. More precisely, it is desired to create a single hardware structure for the tracking and remote transmission of the result of the roll of a die, which is adaptable and usable for various types of dice and possibly transferable between said dice, even if heterogeneous in shape, functions and mode of use; said structure being programmable to recognize and automatically adapt to the different shape and type of dice in which it is applied. It is also desired that this structure, contrary to the commercial electronic dice currently available, is not limited to transmitting all the data obtained from the inertial platform (accelerometer, gyroscope, etc.) to the remote system, but is equipped with its own intelligence and operates in a functionally and energetically more efficient manner, being able to directly transmit the result of the roll, depending on the type of dice in which it is housed and depending on the different expected results (numbers, symbols, characters, commands, etc.) characterizing said die. Furthermore, it is desired that said apparatus for tracking the roll of a die is compatible with the acquisition of the result of simultaneous rolls of multiple dice, possibly heterogeneous, and allows the further processing of the results of the rolls, according to formulas and rules provided for the games in which the dice are otherwise used.

The solution to the aforementioned problems is achieved through a "core" of specific shape, which can be inserted at will in a specific location to be prepared, in advance, in each die, regardless of the number of faces and the type of results which characterize said faces (numbers, symbols, letters, etc.). The core internally houses both the electronic board, responsible for position detection and responsible for remote data transmission, and the battery for the power supply of the electronic board; said core is, therefore, freely insertable, removable and transferable between the various dice, of various shapes and characteristics. The components installed on the electronic board housed in the core are completely equivalent to those integrated in some of the common commercial electronic dice and include an accelerometer, a Radio Frequency transmitter—preferably but not necessarily of the Bluetooth type—a CPU and a memory for information management and process control. According to a further implementation, the components installed on the electronic board may comprise a gyroscope in place of or in combination with said accelerometer.

It should be noted, however, that the core does not constitute a trivial container of the electronics of the die but also represents a modular and highly flexible mechanical tool which, due to the specific shape and functions thereof, allows the free use of the same electronic board for the tracking of the roll and the remote transmission of the result in a plurality of different dice, regardless of the physical and functional characteristics thereof, and that, furthermore, allows the transfer of said same electronic board from one die to another and, further, avoids all customizations that are currently necessary to adapt the electronics of commercial dice to the physical shape of the casings thereof (faces, values, dimensions).

From the mechanical perspective, in fact, the core consists of a nucleus of intentionally asymmetrical geometric shape, which houses both the electronic board responsible for identifying and transmitting the result of the roll of a die, and the power supply battery. In use, said geometric shape corresponds exactly to a dedicated seat previously arranged in the body of dice subject to tracking, regardless of their type.

More generally, the core can be freely inserted inside dice or hollow bodies, typically polyhedral, as long as they are arranged with the aforementioned seat, said seat being suitable and corresponding to the shape of the core itself. The fact that the core hosting the electronic board can be inserted inside these dice or in these polyhedral casings by means of a unique interlocking and, therefore, by means of a single possible orientation, allows to know a priori the relative orientation of the electronic board (and, in particular, of the accelerometer) with respect to the body of the dice or the host casing.

When constructing the dice, therefore, it will be necessary to prepare a seat, adapted to accommodate the core, such that the insertion of the core itself follows a rule and a predetermined and fixed orientation with respect to the geometric shape of the die (for example perpendicular to the first face, or to the second, or to the n-th face of the die where 0<=n<=N faces of the die). By creating a multiplicity of shapes and types of dice, all conforming to the aforementioned geometric rule, the same core and, therefore, the same electronic board, can be transferred from one die to another, since the orientation of the board itself is predetermined and known a priori, with respect to the geometry of the die in which said board is inserted.

Therefore, the relative orientation between the core and the possible host dice being predetermined and known, and consequently, the deviation between the reference system [x, y, z] used by the accelerometer and the reference system [x.q, y.q, z.q] of each of the Q dice (with 1<=q<=Q), it will be possible to determine the result of the rolls based on the orientation of the gravity vector detected by the accelerometer, simply knowing the type of die in which the core is housed (hence the number of faces in the case of regular polyhedra and the values which characterize said faces). In fact, for each type of die (i.e., with the varying in the number of faces, the values represented on said faces and any rules of use also vary), it will be possible to predefine, a priori, a series of tables or "look-up-tables", to be loaded into the memory of the electronic board of the core, said tables defining a priori the assumed orientation of the gravity vector detected by the accelerometer during the use of the die, said values defined at each of the stable positions assumed by the die (and, consequently, the possible results of the roll) and with the varying of the most varied types and shapes of usable dice. In particular, it will be possible to define a priori a table of values for each type of shape and number of faces of said die, for each type of roll result, for each type of rule which interprets the roll results. Said tables being able to be predetermined a priori, on the basis of the physical and geometric characteristics of the different polyhedra and dice containing said core. By suitably storing them in the memory of the electronic board of the core, said core will then become capable of adapting automatically to each type of die in which it will be subsequently inserted.

For each insertion of the core in a different casing or polyhedron or N-face die, it will be sufficient for the remote terminal connected (PC, tablet, smartphone, console or any intermediate mediation and communication hardware) to communicate with the core itself (and therefore with the electronic board hosted) the identification code (q) of the die in which it was inserted (among the possible Q dice which can be used, where 1<=q<=Q) and the system will select and use the table of gravity vectors corresponding to said die and will therefore provide itself with the information necessary to correctly interpret the gravity vector detected by the installed accelerometer and determine and transmit the result of the roll for that particular type of die used and for all the intrinsic characteristics thereof (number of faces, results associated with faces, rules of interpretation and composition for any multiple rolls, etc.). Ultimately, thanks to the shape, or rather to the unique and predefined coupling of the core shape with the polyhedral casing of the different dice, and thanks to a predetermined table (or look-up-table) containing information on the orientation of the accelerometer gravity vector for each possible type of die which can be used, it is possible to use multiple types of dice, without having to have specific electronics for each of them.

In addition, having multiple electronics (cores) and multiple hollow polyhedra (dice bodies), it is possible to create different combinations, depending on the peculiarities of any type of board game and particularly on the variation of the number of dice, the type of dice and the prescribed rules of use.

For the purpose of transmitting the result of the roll of the die or, in the case of a plurality of these, of the combined roll of the dice, the system object of the invention may in fact provide for the use of intermediate mediation and communication hardware, which uses the same radio communication protocol of the electronic boards integrated in the dice cores (not necessarily Bluetooth therefore), thus being able to acquire all the results of the different rolls and to retransmit them, individually or in combination with each other, according to the rules of the game and/or the use scenario, to the remote electronic device (PC, tablet, smartphone, console, etc.) through a further radio or wired communication interface. Said transceiver apparatus may be provided with an appropriate processing unit comprising a memory in which the results of the roll of each of the dice can be stored and a microcontroller capable of combining the different results, according to different rules and expected game situations.

BRIEF DESCRIPTION OF DRAWINGS

Further characteristics and advantages of the proposed technical solution will appear more evident in the following description of a preferred but not exclusive embodiment shown by way of non-limiting example in the accompanying 5 drawings, in which:

FIG. 3 represents the structure of the table or look-up-table preloaded on the core and including the parameters useful for managing the different types of dice in which the core itself can be inserted.

BEST MODE FOR CARRYING OUT THE INVENTION

Figure 1:
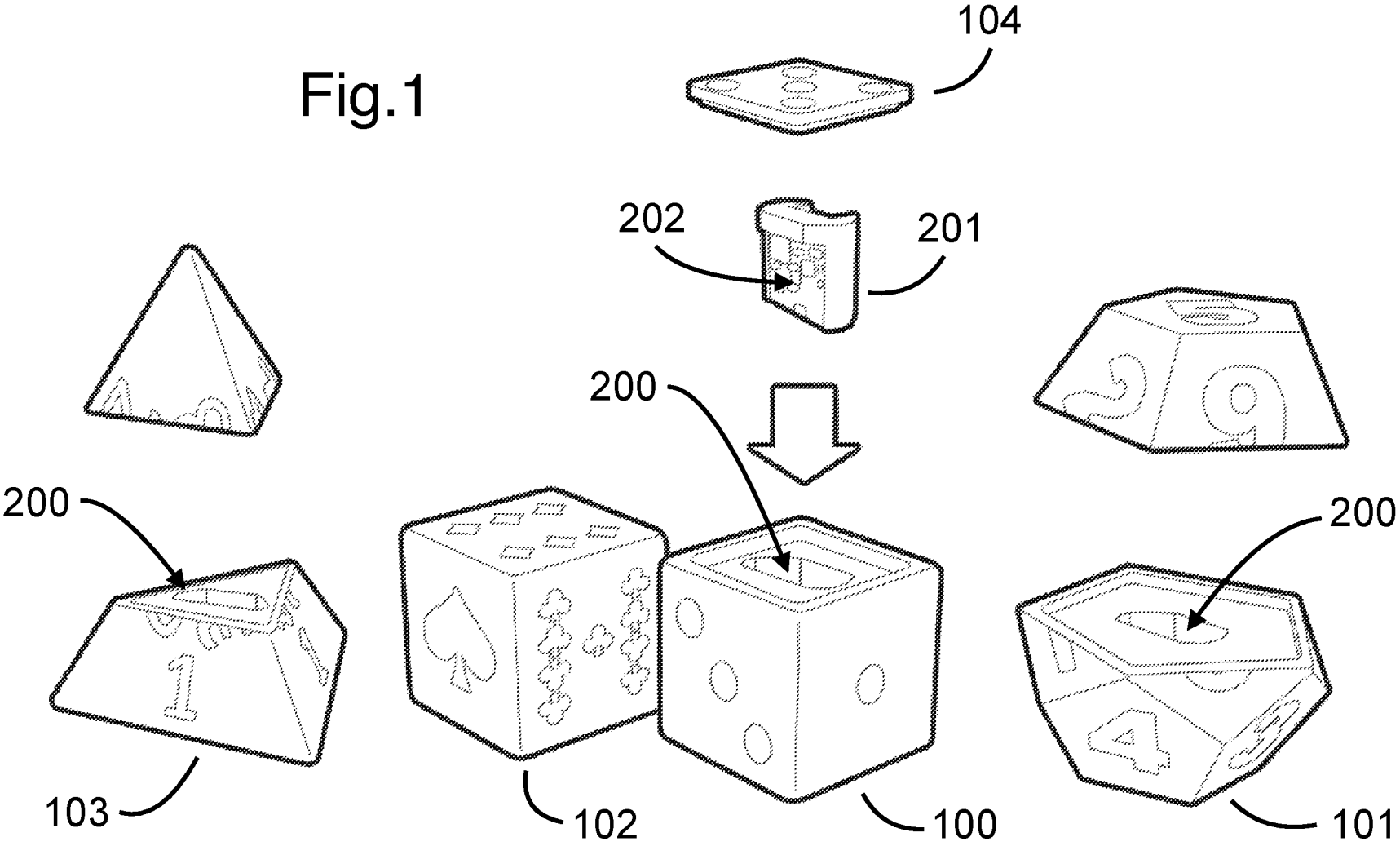
FIG. 1 represents the overall system of the system object of the invention, i.e., the core and some dice of various shapes and types in which said core can be inserted.

With reference to the accompanying drawings, and particularly to FIG. 1 of the same, an example of the system object of the invention is represented and in particular a series of dice characterized by different shapes (100), (101), (102), (103) is represented. Said dice (in this example there are four, but they may be a generic number of Q elements) may be characterized by a number N of possibly different faces as well as possibly different geometric shapes and sizes and characterized by values, or face symbols, which are different and not homogeneous, for example numbers, symbols, characters and/or other signs. Regardless of the various types and functions mentioned above, the dice, according to the proposed invention, are constructed in such a way as to constitute possibly openable casings comprising a closure (104) or casings sectionable into parts (101), (103).

The opening of the dice allows access to a seat (200) in which a core element (201) can be inserted uniquely and according to a single orientation. Inside said core (201) is an electronic board (202); said board used to determine the result of the roll of said die housed in the core itself. The core 201 may then be optionally transferred between various dice (100), (101), (102), (103) and optionally moved into additional dice. The insertion of the core takes place by opening the different casings of said dice and inserting the core in the same seat (200) obtained in each of the usable dice (100), (101), (102), (103).

Figure 2:
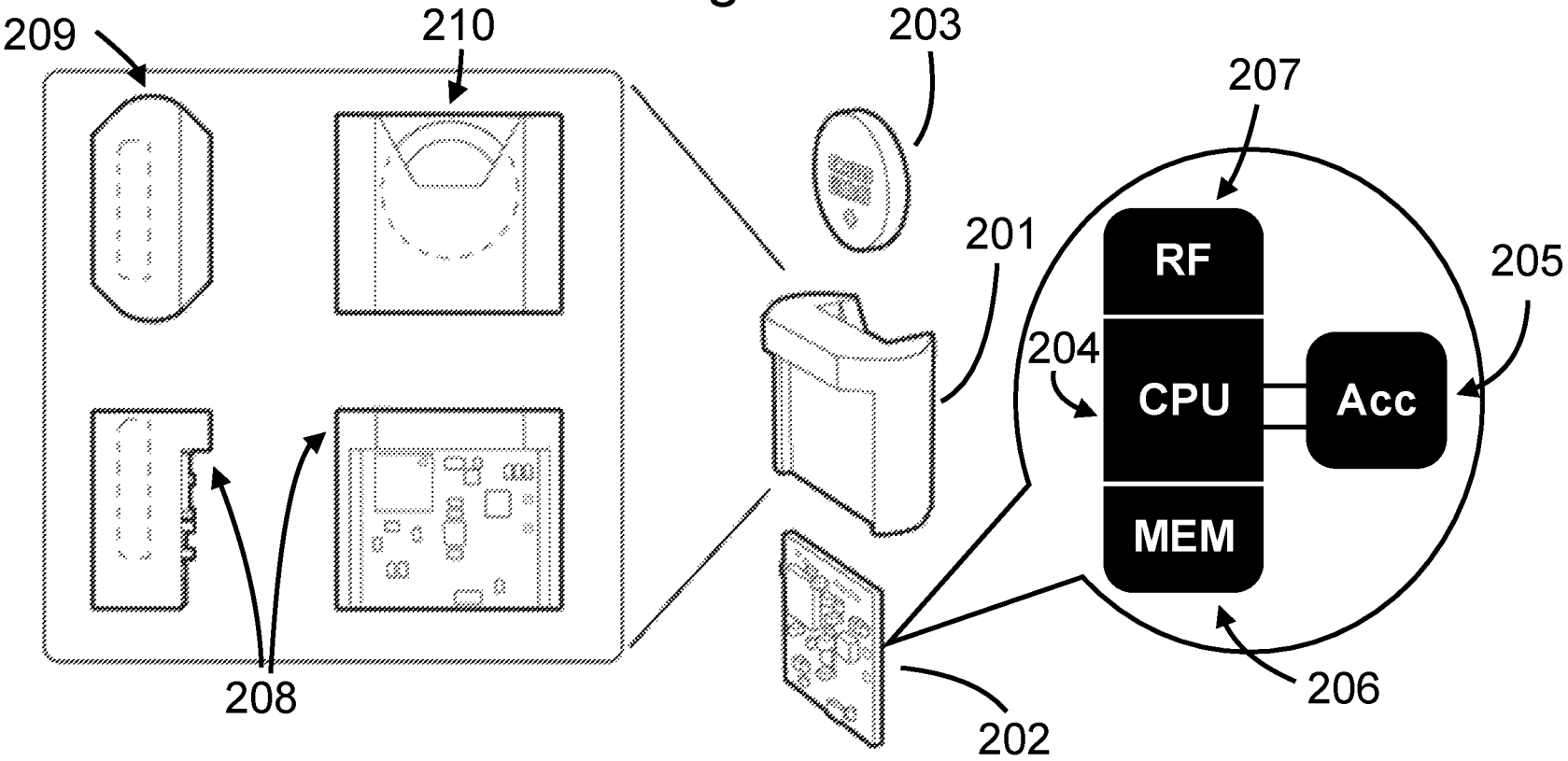
FIG. 2 represents in detail the core and the components thereof and in particular the components of the electronic board inserted in said core.

With reference to the accompanying drawings, and particularly to FIG. 2, the core (201) is depicted in detail and in particular the shape and components housed therein. The core (201) contains the aforementioned electronic board (202) and a battery (203) for the power supply of said board. The electronic board (202) further comprises a CPU (204), an accelerometer (205), a memory (206) and a radio frequency remote transmission system (207), said radio frequency remote transmission system (207) being preferably but not necessarily of the Bluetooth type. Also with reference to the drawings of FIG. 2, a preferable, but not exclusive, form of the physicality of the core (201) and particularly of the asymmetrical profile thereof is represented, highlighted by its different perspectives (208), (209), (210), said asymmetric profile being used to obtain a unique interlocking with the shape of the corresponding seat (200). Said constructive asymmetry ensures that the insertion of the core (201) into the seat (200) can only take place according to a single direction, guaranteeing a fixed orientation, known a priori and predetermined of the accelerometer reference system (205), by varying all possible dice in which the core (201) is inserted.

With reference to the accompanying drawings, and particularly to FIG. 3, a look-up-table (300) is represented which has sub-tables (301), (302), (303). This look-up-table, with the variation of all the dice which can be used [1, . . . , q, . . . , Q] and the variation of the Nq possible faces of said dice, represents the values assumed by the components of the gravity vector [Vx, Vy, Vz] detected by the accelerometer (205), at each of the Nq faces. The various sub-tables (301), (302), (303) etc., therefore represent all the different possible creations (depending on the types of dice, the type of faces, the type of rules or game to be used) and allow the core to be pre-programmed to interpret the roll of any die, in any context, for each possible type and application scope and allow the core to, from time to time, select, load and use the sub-table (301), (302), (303), etc., adapted and corresponding to the game context.

The matrix of the look-up-table (300) further contains a column in which an asymptotic stability parameter of the roll of the die DV is written, settable a priori. This parameter will typically but not necessarily be identical for all dice and determines after how long the gravity vector measured by the accelerometer (205) can be considered as a stable and reliable value. This is to avoid that the data provided by the accelerometer (205) are considered valid results during the rolling of the die or during oscillations and small involuntary movements, not related to actual use, which would cause errors in the detection of the result.

The look-up-table (300) contains a further parameter dV, which is also settable a priori. Said parameter defines the spatial or geometric stability of the roll, which is instead dependent on the physical shape of the die, particularly on the number of faces thereof. The spatial stability parameter dV of the die is used to interpret and, if necessary, compensate for small inconsistencies between the gravity vector actually measured by the accelerometer (205) during rolls with respect to the gravity vector values provided by the look-up table (300). Such inconsistencies may be attributable, for example, to irregularities in the gaming table on which the dice are rolled. To this end, it will be necessary to verify whether the deviation between the actual gravity vector measured by the accelerometer (205) at the end of the roll and the theoretical value of the gravity vector [Vx, Vy, Vz] provided in the look-up-table is within the permitted tolerance. This is to discern if there are small deviations attributable to surface defects or if an unreliable roll has occurred (die incorrectly positioned on an edge, for example, or inclined due to the presence of obstructions and interfering objects). The parameter dV allows to set the limit within which said deviations are acceptable and varies depending on the type of die because, as the number of faces which characterize a die increases, said deviations obviously become more dangerous and, as a result, greater precision is required to discern the correctness and regularity of the roll. As the number of faces increases, in fact, it happens that the faces of the adjacent dice are characterized by gravity vectors quite similar to each other, so it is necessary to carefully verify the correspondence with the expected gravity vector and large deviations from the expected values cannot be accepted. This parameter, therefore, will vary considerably with the variation of the different sub-tables provided for the different types of dice (301), (302), (303), etc.

Finally, again referring to FIG. 3, a column of RESULTS is represented; since the same die with the same number of faces may have different symbols and values on the faces. For this reason, a sub-table is provided for each different embodiment and use of the die, so that, depending on the sub-type of die used, the system is able to communicate the correct result (for example, a die of 6 can have results 1, 2, 3, 4, 5, 6 or A, B, C, D, E, F. etc.). In this regard, it is noted that the number of sub-tables which form the overall look-up-table (300) will be reasonably higher or at most equal to that of the Q dice usable with the same core (201).

Figure 4:
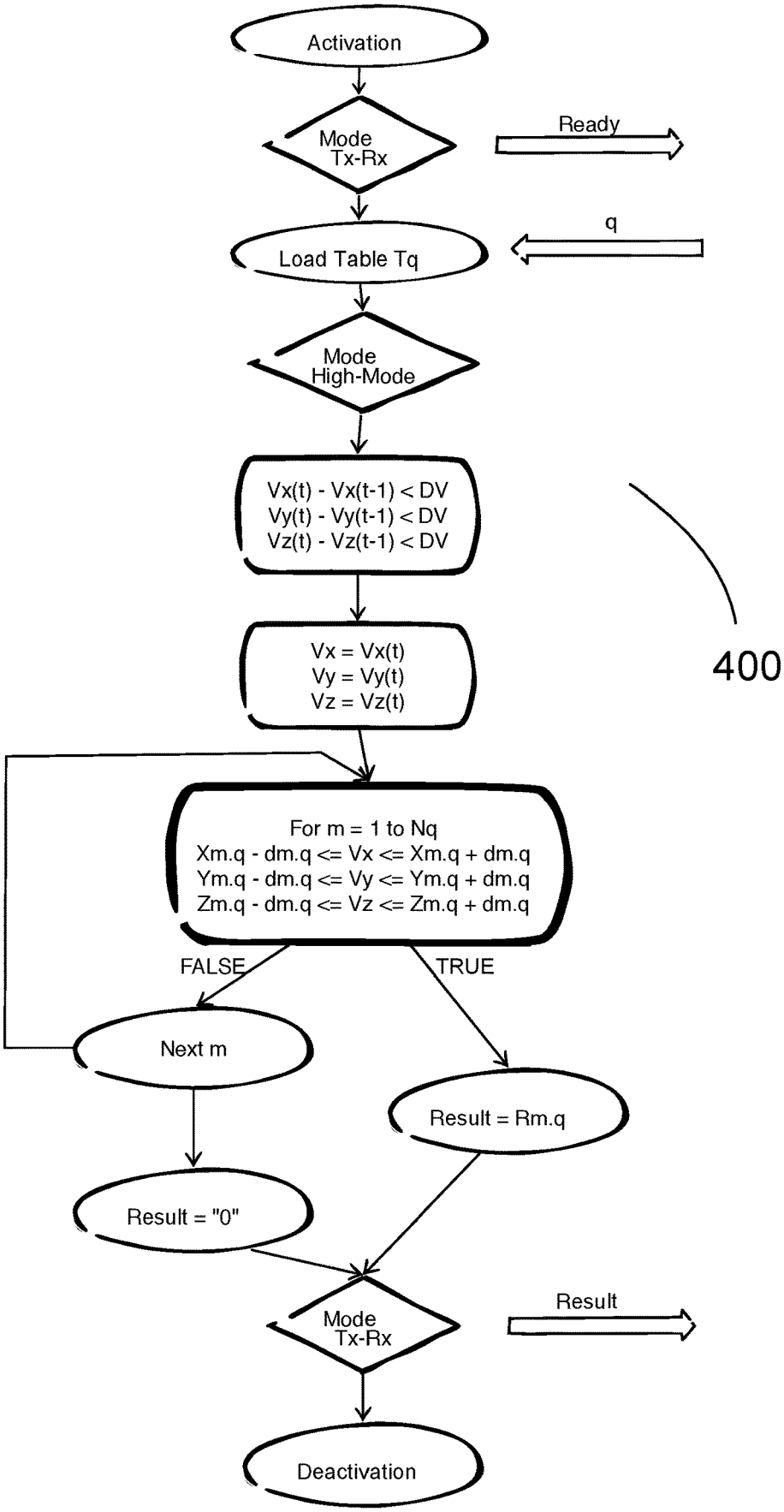
FIG. 4 represents the algorithm for managing the electronic board for remote dice roll detection and transmission.

With reference to the accompanying drawings, and particularly to FIG. 4, the algorithm which regulates the operation of the system is represented and in particular:

1. Core signalling to the remote terminal of successful insertion into a die;
2. Transmission by the remote terminal of the index of the die (q-th) in which said core has been inserted;
3. Selection, in the look-up-table (300) housed in the memory (206) of the electronic board (202), of the sub-table (303) relative to the q-th die and the context used;
4. Verification of asymptotic temporal stability following the roll (using the parameter DV);
5. Verification of the spatial and geometric stability of the die roll (using the parameter dV);
6. Transmission of the roll result, only if the measured value is acceptable according to the two previous checks.

Figure 5:
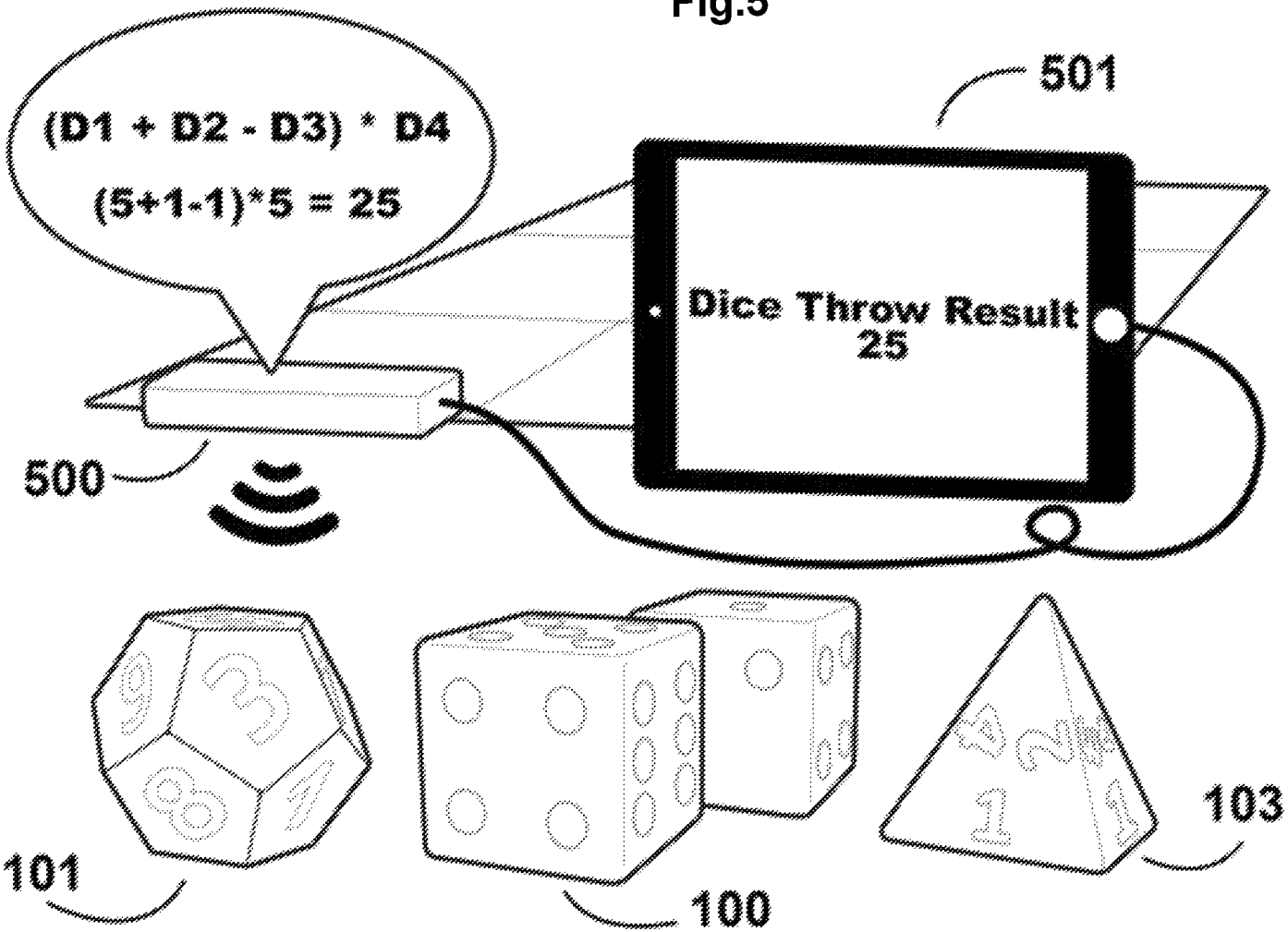
FIG. 5 represents an alternative implementation which involves the use of a device with a gateway or mediator function, used to manage and possibly combine a plurality of dice.

With reference to the accompanying drawings, and particularly to FIG. 5, an alternative embodiment is depicted providing a device (500) with gateway or mediator function to a connected remote electronic device (501). Said device may be available if it is necessary to manage and intermediate the roll data of one or more dice, useful, for example, for a large number of dice to be managed or if a preprocessing stage of the results of rolls related to the dice used (100), (101), (102), (103) is required, depending on the type of game or application scope in which said dice are used. The connection between said device used as a mediator (500) and the remote electronic device (501) may be wired, as shown in FIG. 5, or wireless, using different transmission protocols useful for the purpose.

INDUSTRIAL APPLICABILITY

The invention can be realized with technical equivalents, with supplementary materials or solutions suitable for the purpose and the application scope. Conformation and dimensions of the constituent parts may vary in a suitable, but consistent way with the proposed solution. By way of non-limiting example, it is noted that the geometric shapes of the involved parts may be varied while maintaining the above-mentioned functionalities. In particular, the shapes of the core (201) and the corresponding seats (200) obtained in the cavities of the dice (100) may change. At the hardware level, it will be possible to change the number and type of sensors installed on the board (202), including any and additional types of sensors for detecting the spatial orientation assumed by the die itself, therefore, alternative or additional to the aforementioned accelerometer such as a gyroscope. In addition, the technology implemented for the wireless transmission of data between the die and the receiving electronic device and, in particular, the type of protocol used may be changed, without however going beyond the scope of the peculiar characteristics and functions of the system proposed and claimed below. By varying these implementations, it will be necessary to change the conditioning, acquisition and communication circuits between elements, without, however, departing from the purpose and scope of application of the proposed solution. Finally, the invention may also be partially realized.

The invention claimed is:

1. A modular electronic dice system for determining a result of a roll of a die and transmitting the result to a remote electronic terminal, comprising:

a control board used to trace Q different types of dice, each of the dice comprising a variable number Nq of faces, wherein Q and Nq are natural numbers, and the control board comprising an accelerometer or a gyroscope, a memory, a central processing unit (CPU), and a wireless communication system;

a core comprising a housing for housing the control board, the core being insertable according to a single orientation in a suitable seat, the suitable seat being obtained in each of the Q different types of dice, according to a predetermined position and orientation;

a look-up-table preloaded into the memory of the control board, the look-up-table containing expected values of a gravity vector [Vx, Vy, Vz], provided by the accelerometer or the gyroscope, the expected values being predetermined for each of the Nq positions assumed by the different Q dice at valid results of the roll of the dice, wherein the gravity vector [Vx, Vy, Vz] provided by the accelerometer or the gyroscope at a conclusion of the roll of a die is detected by controlling an asymptotic stability of the values assumed by the gravity vector [Vx(t), Vy(t), Vz(t)] in a time domain, wherein the result of the roll of a die is determined by comparing the gravity vector [Vx, Vy, Vz], provided by the accelerometer or the gyroscope with the expected values of the gravity vector contained in the look-up-table, and determining the value of the roll result to be transmitted to the remote electronic terminal.

2. The modular electronic dice system according to claim 1, wherein controlling the asymptotic stability of the gravity vector [Vx(t), Vy(t), Vz(t)] in the time domain compares components of the vector at two successive sampling instants "t−1" and "t" and verify that the difference between the corresponding vector components is less than a predetermined parameter DV, according to formulas:

$$Vx[t]-Vx[t-1]<DV,$$

$$Vy[t]-Vy[t-1]<DV, \text{ and}$$

$$Vz[t]-Vz[t-1]<DV.$$

3. The modular electronic dice system according to claim 1, wherein determining the result of the roll of a die further comprises a system for verifying and possibly compensating for the differences between the expected values of the gravity vector contained in the look-up-table and an actual value of the gravity vector [Vx, Vy, Vz] acquired by the accelerometer or the gyroscope, the system comprising a parameter dV defining a maximum permissible deviation for each of the components of said gravity vector [Vx, Vy, Vz], with respect to the corresponding expected values for each of the Nq faces of the different types of dice.

4. The modular electronic dice system according to claim 1, wherein the look-up-table is divided into Q sub-tables associated with the Q types of usable dice, each sub-table containing data and parameters necessary to determine the results of the rolls of a die equipped with said control board, the data and the parameters being organized according to a number of rows of equal to the number of faces Nq of each die and comprising:

the expected value of the gravity vector [Vx, Vy, Vz] at an end of the die roll;

a parameter dV used to evaluate and compensate for the differences between the expected values of the gravity vector contained in the look-up-table and an actual value of the gravity vector [Vx, Vy, Vz] provided by the accelerometer or the gyroscope;

the parameter DV used to control the asymptotic stability, in the time domain, of the gravity vector [Vx(t), Vy(t), Vz(t)] provided by the accelerometer or the gyroscope; and the roll result to be transmitted to the remote electronic terminal.

5. The modular electronic dice system according to claim 1, further comprising a mediator device connected to the remote electronic terminal and configured to communicate bidirectionally with the control board and process the roll results of a plurality of dice equipped with the control board.

6. The modular electronic dice system of claim 1, wherein the core further comprises a housing for a battery.

7. A method for tracking and transmitting a result of a roll of dice, comprising:

providing a control board used to trace different types of dice, each of the dice comprising a variable number of faces, and the control board comprising an accelerometer or a gyroscope, a memory, a central processing unit (CPU), and a wireless communication system;

providing a core comprising a housing for housing the control board, the core being insertable according to a single orientation in a suitable seat, the suitable seat being obtained in each of the different types of dice, according to a predetermined position and orientation;

providing a look-up-table preloaded into the memory of the control board, the look-up-table containing expected values of a gravity vector, provided by the accelerometer or the gyroscope, the expected values being predetermined for each of the positions assumed by the different dice at valid results of the roll of the dice;

providing the different types of dice;

checking a presence of an remote electronic terminal;

receiving from the remote electronic terminal an index "q", where 1<=q<=Q, associated with the die in whose seat the core containing the control board is inserted;

selecting, in the look-up-table preloaded into the memory, a sub-table indexed by "q" and loading data and configuration parameters of the control board, the data and parameters being contained in Nq rows of the selected sub-table;

detecting the gravity vector [Vx, Vy, Vz] provided by the accelerometer or the gyroscope at a conclusion of the roll of a die;

checking an asymptotic stability of the values assumed by the gravity vector in a time domain of the gravity vector (Vx(t), Vy(t), Vz(t)) provided by the accelerometer or the gyroscope, and acquiring the gravity vector (Vx, Vy, Vz);

identifying the roll result by performing a comparison between the gravity vector [Vx, Vy, Vz] provided by the accelerometer and the Nq expected values contained in the sub-table "q" selected and loaded; and transmitting the roll result to the remote electronic terminal.

8. The method according to claim 7, wherein identifying the roll result further comprises compensating for differences between the expected values of the gravity vector and an actual acquired value of the gravity vector [Vx, Vy, Vz] by a parameter dV, the parameter dV being employed to define a maximum allowable deviation for each vector component.

9. The method according to claim 7, wherein transmitting the roll result comprising transmitting the result of the roll to a mediator device.

10. A modular electronic dice system, comprising:

Q different types of dice, each of the dice comprising a variable number Nq of faces;

a control board configured to trace the Q different types of dice, wherein Q and Nq are natural numbers, the control board comprising an accelerometer or a gyroscope, a memory, a central processing unit (CPU), and a wireless communication system;

a core comprising a housing for housing the control board, the core being insertable according to a predetermined orientation in a seat, the seat being obtained in each of the Q different types of dice;

a look-up-table preloaded into the memory of the control board, the look-up-table containing expected values of a gravity vector provided by the accelerometer or the gyroscope, the expected values being predetermined for each of the Nq positions assumed by the different Q dice at valid results of a roll of the dice; and processing circuitry configured to detect the gravity vector provided by the accelerometer or the gyroscope at a conclusion of the roll of a die, the processing circuit being configured to control a asymptotic stability of the values assumed by the gravity vector in a time domain, and determine the result of the roll of a die by comparing the gravity vector, provided by the accelerometer or the gyroscope with the expected values of the gravity vector contained in the look-up-table, and determining the value of the roll result to be transmitted to a remote electronic terminal.

11. The modular electronic dice system of claim 10, wherein the core signals to the remote electronic terminal upon successful insertion into at least one die of the Q different types of dice, wherein the remote electronic terminal communicates an index associated with the die in whose seat the core containing the control board is inserted.

12. The modular electronic dice system of claim 10, further comprising:

a mediator device communicatively connected with the control board and configured to processing the roll results of a plurality of dice equipped with the control board in accordance with a predefined rule set.

* * * * *